US012134128B2

(12) United States Patent
Liu et al.

(10) Patent No.: US 12,134,128 B2
(45) Date of Patent: Nov. 5, 2024

(54) METHOD FOR PREPARING NANO SPHERICAL OXIDE DISPERSION STRENGTHENING PHASE

(71) Applicant: CENTRAL SOUTH UNIVERSITY, Changsha (CN)

(72) Inventors: Zuming Liu, Changsha (CN); Sizhe Lu, Changsha (CN); Quan Li, Changsha (CN); Bing Wei, Changsha (CN); Xu Zhou, Changsha (CN); Bizhong Nong, Changsha (CN); Yake Ren, Changsha (CN); Yongkang Ai, Changsha (CN); Bin Cao, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 474 days.

(21) Appl. No.: 17/533,074

(22) Filed: Nov. 22, 2021

(65) Prior Publication Data

US 2022/0111437 A1 Apr. 14, 2022

Related U.S. Application Data

(63) Continuation of application No. PCT/CN2021/087171, filed on Apr. 14, 2021.

(30) Foreign Application Priority Data

Oct. 14, 2020 (CN) ..... 202011097004.8

(51) Int. Cl.

| | |
|---|---|
| ***B22F 9/04*** | (2006.01) |
| ***B22F 1/0545*** | (2022.01) |
| ***B22F 1/065*** | (2022.01) |
| ***B22F 1/142*** | (2022.01) |
| ***B22F 1/145*** | (2022.01) |
| ***B22F 3/15*** | (2006.01) |
| ***B22F 3/18*** | (2006.01) |
| ***B22F 3/24*** | (2006.01) |
| ***C22C 32/00*** | (2006.01) |

(52) U.S. Cl.

CPC ..... *B22F 1/0545* (2022.01); *B22F 1/065* (2022.01); *B22F 1/142* (2022.01); *B22F 1/147* (2022.01);

(Continued)

(58) Field of Classification Search

CPC ..... B22F 9/04; B22F 2009/043; C22C 32/001–0042

See application file for complete search history.

(56) References Cited

U.S. PATENT DOCUMENTS

2019/0185974 A1* 6/2019 Yan ..... C22C 32/0036

FOREIGN PATENT DOCUMENTS

CN 1664145 A 9/2005
CN 101265530 A 9/2008

(Continued)

OTHER PUBLICATIONS

T. Okuda, et al., Dispersion behaviour of oxide particles in mechanically alloyed ODS steel, Journal of Materials Science Letters, 1995, pp. 1600-1603, vol. 14.

(Continued)

*Primary Examiner* — Samir Shah
*Assistant Examiner* — Sean P. O'Keefe
(74) *Attorney, Agent, or Firm* — Bayramoglu Law Offices LLC

(57) ABSTRACT

A method for preparing a nano spherical oxide dispersion strengthening phase using a micron oxide is proposed for the first time. First, a micron oxide is used as a raw material to prepare a nano oxide with a completely amorphous structure/matrix alloy composite powder by mechanical ball milling in stages. In the first stage, ball milling is performed, causing the oxide to break and transform in structure, and achieving nano-sizing and completely amorphization, to prepare a composite powder with a completely amorphous (Continued)

structure nano oxide uniformly distributed in the matrix alloy powder; and in the second stage, the composite powder obtained in the first stage and the remaining matrix alloy powder are uniformly mixed by ball milling. Then, the uniformly mixed powder is sequentially subjected to hot forming, hot rolling, and heat treatment, to obtain a nano spherical oxide dispersion strengthened alloy.

18 Claims, 3 Drawing Sheets

(52) U.S. Cl.
CPC ..... *B22F 9/04* (2013.01); *C22C 32/0026* (2013.01); *B22F 3/15* (2013.01); *B22F 3/18* (2013.01); *B22F 2003/185* (2013.01); *B22F 3/24* (2013.01); *B22F 2003/248* (2013.01); *B22F 2009/043* (2013.01); *B22F 2302/25* (2013.01); *B22F 2304/10* (2013.01)

(56) References Cited

FOREIGN PATENT DOCUMENTS

| | | | | | |
|---|---|---|---|---|---|
| CN | 102814503 | A | | 12/2012 | |
| CN | 102994884 | A | | 3/2013 | |
| CN | 108080644 | A | * | 5/2018 | ..... B22F 9/04 |
| CN | 108907209 | A | * | 11/2018 | ..... B22F 1/0014 |
| CN | 108950357 | A | | 12/2018 | |
| CN | 111254335 | A | * | 6/2020 | ..... B22F 1/0003 |

OTHER PUBLICATIONS

Yuuji Kimura, et al., Ultra Grain Refining and Decomposition of Oxide during Super-heavy Deformation in Oxide Dispersion Ferritic Stainless Steel Powder, ISIJ International, 1999, pp. 176-182, vol. 39, No. 2.

Shashanka. R, et al., Phase transformation and microstructure study of nano-structured austenitic and ferritic stainless steel powders prepared by planetary milling, Powder Technology, 2014, pp. 125-136, vol. 259.

Wenxue Li, et al., The effect of Zr, Ti addition on the particle size and microstructure evolution of yttria nanoparticle in ODS steel, Powder Technology, 2017, pp. 172-182, vol. 319.

Lin Zhang, et al., Y2O3 evolution and dispersion refinement in Co-base ODS alloys, Acta Materialia, 2009, pp. 3671-3682, vol. 57.

Behnoush Dousti, et al., Microstructural evolution and chemical redistribution in Fe—Cr—W—Ti-Y2O3 nanostructured powders prepared by ball milling, Journal of Alloys and Compounds, 2013, pp. 409-416, vol. 577.

Xu Yan-Long, et al., Preparation of MgO dispersion strengthen ferrous materials by internal oxidation, Materials Science and Engineering of Powder Metallurgy, 2015, pp. 431-437, vol. 20, No. 3.

* cited by examiner

METHOD FOR PREPARING NANO SPHERICAL OXIDE DISPERSION STRENGTHENING PHASE

CROSS REFERENCE TO THE RELATED APPLICATIONS

This application is a Continuation Application of International Application No. PCT/CN2021/087171, filed on Apr. 14, 2021, which is based upon and claims priority to Chinese Patent Application No. 202011097004.8, filed on Oct. 14, 2020, the entire contents of which are incorporated herein by reference.

TECHNICAL HELD

The present disclosure relates to a method for preparing a nano spherical oxide dispersion strengthening phase, and belongs to the field of powder metallurgy (PM) materials.

BACKGROUND

Oxide dispersion strengthened (ODS) alloys have excellent mechanical properties and resistance to oxidation and high-temperature corrosion, and have broadly application prospects.

At present, mechanical alloying (MA) and internal oxidation are two main methods used to introduce an oxide into an alloy matrix to prepare an ODS alloy. Generally, an oxide powder such as $Y_2O_3$ is mixed with a raw material powder, and is dispersed into the raw powder to form the mixture powder by mechanical ball milling, and then the mixture powder is formed to obtain an oxide dispersion alloy [T Okuda, et al., J Mater Sci Lett 14 (1995) 1600; and Y Kimura, et al., ISIS International 39 (1999) 176]; or, $Y_2O_3$ is decomposed into Y and O atoms by MA for long-time, and Y and O atoms are solid-solved in a Fe matrix to form a supersaturated solid solution by Y and O atoms, and Y and O atoms reconstruct an oxide strengthening phase during powder hot forming [R Shashanka, et al., Powder Technol 259 (2014) 125; and Li Wenxue, et al., Powder Technol 319 (2017) 172]. It is complex to break down and decompose $Y_2O_3$ into Y and O atoms and then solid-solve the Y and O atoms in an iron alloy matrix by MA. In the subsequent forming process, a large-sized oxide with inhomogeneous distribution tends to be formed, which leads to significant reduction in the mechanical properties of the alloy [Liii Zhang, et al., $Y_2O_3$ evolution and dispersion refinement in Co-base ODS alloys. Acta Materialia 57(2009)3671]. The elemental metal Fe, Cr, W, and Ti powder was mechanically alloyed with $Y_2O_3$ powder, as reported by Dousti et al. [Behnoush Dousti, et al., Journal of Alloys and Compounds 577 (2013) 409], but $Y_2O_3$ in the prepared mechanically alloyed powder has coarse particle sizes and no new oxide strengthening phase is formed.

In view of the foregoing problems, an MgO dispersion-strengthened iron-based alloy was prepared through internal oxidation, as reported by Xu Yanlong et al. [Xu Yanlong et al., Materials Science and Engineering of Powder Metallurgy, 2015, 22(3): 431-437]. The obtained strengthening phase is a single MgO phase with a size greater than 1 μm, and the room temperature tensile strength of the alloy is at most 342 MPa. Chinese Patent No. CN1.02994884A discloses an efficient method for preparing a nano oxide dispersion strengthened steel. Instead of the conventional process of atomization of a master alloy (the master alloy does not contain Y and Ti) and then MA of atomized powder with $Y_2O_3$ and Ti for a long time, atomization is used to directly (in one step) prepare solid solution alloy powder supersaturated with Y and Ti. However, this patent does not provide a method for introducing oxygen required to form an oxide strengthening phase. Chinese Patent No. CN101265530A discloses a method for preparing a cluster dispersion-strengthened iron-based alloy by mold pressing an atomized pre-alloyed iron-based powder at room temperature, sintering at 1350° C. for 2 h to prepare a billet for forging, and then forging at 900° C. to 1200° C. This method has a simple preparation process, but the powder surface was oxidized due to the long-time exposure at high temperature, which reduces the mechanical properties of the material. Therefore, it is difficult to prepare a high-performance ODS iron-based alloy. Chinese Patent No. CN1664145A discloses a method for preparing an ODS ferritic alloy by chemical infiltration. A pre-alloyed powder is soaked with a $Y(NO_3)_3 \cdot 6H_2O$ solution, and after drying, is then decomposed into $Y_2O_3$ by heating under a hydrogen atmosphere to obtain a $Y_2O_3$ dispersion-strengthened ferritic alloy powder, which is then hot degasified to prepare a bulk material. This method introduces new contamination due to the use of chemical reagents, and is inconvenient to operate. Moreover, because $Y_2O_3$ particles are mainly attached to the powder surface, and in the subsequent powder forming process, $Y_2O_3$ segregates at the interface of the original powder to form large-size oxide particles, causing inhomogeneous distribution of $Y_2O_3$ in the prepared bulk material, and the dispersion effect cannot be ensured. Chinese Patent No. CN201110154483.7 discloses a method for preparing a nano-scale $Y_2O_3$ particle dispersion strengthened ferritic alloy steel powder. First, ethylenediaminetetraacetic acid and chromium nitrate are added to water and stirred at 50-60° C. for at least 12 h to obtain a mixed solution. Then citric acid, ferric nitrate, ammonium paratungstate, yttrium nitrate, and tetrabutyl titanate are added to the mixed solution and stirred at 60-70° C. for at least 3 h to obtain a sol. Subsequently, polyethylene glycol is added to the sol and stirred at 70-80° C. until a gel is formed. Finally, the gel is dried at 100-120° C. for at least 12 h, and then baked at 300-600° C., for 4-5 h, to obtain a precursor oxide powder. The precursor oxide powder is calcined at 1100-1300° C. for at least 3 h under a reducing atmosphere, to prepare a nano-scale $Y_2O_3$ particle dispersion strengthened ferritic alloy steel powder with $Y_2O_3$ uniformly distributed in a matrix composed of chromium, tungsten, titanium, and iron. The powder consists of chromium, tungsten, titanium, and $Y_2O_3$ at a ratio of 12-14 wt. %: 2-3 wt. %: 0.2-0.5 wt. %: 0.1-1.0 wt. %, with the rest being iron, and the powder shape is granular or cylindrical. The granular powder has a particle size of 1-10 μm, and the cylindrical powder has a diameter of 2-5 μm, and a length of 5-10 μm. Alternatively, the powder is of an ellipsoid shape with a major axis of 15-20 nm and a minor axis of 10-15 nm. This is a chemical method for preparing powder, by which a powder with $Y_2O_3$ uniformly dispersed in the matrix can be obtained.

SUMMARY

Technical Problem

However, there is no report on how to prepare a spherical, especially a nano spherical oxide strengthening phase.

A micron oxide is used to mix with a matrix alloy powder, and to prepare a composite powder with a uniformly distributed amorphous nano oxide by mechanical ball milling in stages; in the first stage, the micron oxide and a first part of the matrix alloy powder are mixed and ball milled to prepare a composite powder with a completely amorphous structure nano oxide uniformly distributed in the matrix alloy powder; in the second stage, the composite powder obtained in the first stage is uniformly mixed with the remaining matrix alloy powder by ball milling to obtain the uniformly mixed powder; and then the uniformly mixed powder is sequentially subjected to hot forming, hot rolling, and heat treatment, to obtain a nano spherical oxide dispersion strengthened alloy.

Solution to the Problem

Technical Solution

The present disclosure is developed on the previous research (for example, Application No. CN201810845451.3) of the inventor team. The present disclosure provides a method for preparing a nano spherical oxide dispersion strengthening phase, and proposes using a micron oxide to prepare a nano spherical oxide strengthening phase for the first time. First, a composite powder with a uniformly distributed amorphous nano oxide is prepared by mechanical ball milling in stages: in the first stage, the micron oxide and a first part of the matrix alloy powder are mixed and ball milled to prepare a composite powder with a completely amorphous structure nano oxide uniformly distributed in the matrix alloy powder; in the second stage, the composite powder obtained in the first stage is uniformly mixed with the remaining matrix alloy powder by ball milling to obtain the uniformly mixed powder; and then the uniformly mixed powder is sequentially subjected to hot forming, hot rolling, and heat treatment, to obtain a nano spherical oxide dispersion strengthened alloy. Compared with the patent of Application No. CN201810845451.3, the elongation of the product obtained in the present disclosure is significantly improved.

According to the method for preparing a nano spherical oxide dispersion strengthening phase in the present disclosure, an alloy powder with a dispersed nano oxide is prepared by mechanical ball milling using a pre-alloyed powder and at least one selected from the group consisting of $Y_2O_3$ and $TiO_2$, and then the alloy powder is subjected to hot forming, hot rolling, and heat treatment to obtain an alloy with a nano spherical oxide dispersion strengthening phase. The alloy prepared by this method not only has a high room-temperature and elevated temperature tensile strength, but also has excellent plasticity and toughness (specifically represented in elongation), and its comprehensive mechanical properties are obviously superior to those of the same brand and same type alloys. At present, there is no report on the method for preparing a nano spherical oxide dispersion strengthening phase.

According to the method designed in the present disclosure, the elongation of the product can be significantly improved while ensuring the high tensile strength of the product.

According to the method for preparing a nano spherical oxide dispersion strengthening phase in the present disclosure, an oxide powder is used as a raw material A and an alloy powder is used as a raw material B. First, the raw material A and a first part of the raw material B are mixed and ball milled to obtain a composite powder C with uniformly distributed nano oxide particles. Then, the composite powder C and the remaining raw material B are mixed and ball milled to obtain a composite powder D. The composite powder D is subjected to hot forming, hot rolling, and heat treatment to prepare a nano oxide dispersion strengthened alloy. The mass ratio of the raw material A to the first part of the raw material B is 1: (1-10), preferably 1: (1-5), and further preferably 1: (3-5). The mass ratio of the raw material A to the raw material B is (0.5-5):(99.5-95), preferably (0.5-3):(99.5-97), and further preferably (1-2): (99-98).

The nano spherical oxide dispersion strengthening phase includes at least one selected from the group consisting of $Y_2O_3$, $TiO_2$, $Y_2TiO_5$, $Y_2TiO_7$, and Y—Ti—O. The size of the nano spherical oxide dispersion strengthening phase is less than or equal to 100 nm. The matrix is one selected from the group consisting of a Fe—Cr—W—Ti or Fe—Cr—W alloy, a nickel-based superalloy, a copper alloy, and a high-entropy alloy. The particle size of the oxide powder A is less than 10 μm. The particle size of the alloy powder B is less than or equal to 150 μm. In the present disclosure, the nano spherical oxide dispersion strengthening phase is formed in the subsequent hot forming, hot rolling, and heat treatment The present disclosure provides a method for preparing a nano spherical oxide dispersion strengthening phase, including the following steps:

step 1: weighing a powder material according to a mass ratio of a raw material A to a raw material B of (0.5-5):(99.5-95); taking milling balls according to a mass ratio of a total mass of the powder material to a mass of the milling balls of 1: (10-20); and filling the raw material A, a first part of the raw material B, and the milling balls into a milling can, and then sealing the milling can, wherein the milling balls with diameters of 18-22 mm, 14-16 mm, 9-11 mm, 7-8.5 turn, 4.5-5.5 mm, and 2.5-3.5 mm are compatible according to a mass ratio of 1-2:1-2:1-2:1-2:1-2:1-2:1-2; and the mass ratio of the raw material A to the first part of the raw material B is 1: (1-10), preferably 1: (1-5), and further preferably 1: (3-5);

step 2: vacuumizing the milling can, and then filling the milling can with an inert gas;

step 3: installing the milling can in step 2 into a planetary ball milling machine to perform mechanical ball milling, wherein the mechanical ball milling parameters include a milling time of 60-120 h, and a milling rotating speed of 200-300 r/min;

step 4: after the mechanical ball milling is completed, sieving the powder under an inert gas atmosphere in a glovebox to obtain a composite powder C with uniformly distributed oxide;

step 5: mixing the composite powder C and the remaining powder B and filling into the milling can, and installing the milling can into the planetary ball milling machine, and then performing mechanical ball milling, to obtain a composite powder D; and step 6: sequentially subjecting the obtained composite powder D to hot forming, hot rolling, and heat treatment, to obtain a nano spherical oxide dispersion strengthened alloy.

In industrial applications, step 4 may be omitted directly. The addition of step 4 is mainly to further improve the performance of the product.

In step 5, to improve efficiency, the second ball milling is mainly for even mixing. The ball-to-powder ratio is the mass ratio of a total mass of the powder material to a mass of the milling balls and is equal to 1: (5-10), and the mechanical ball milling parameters include a milling time of 20-40 h, and a milling rotating speed of 200-300 r/min. That is, in actual operations, the composite powder C and the remaining powder B are mixed and filled into the milling can, the milling balls are supplemented, and then the milling can is installed into the planetary ball milling machine, and then mechanical ball milling is performed, to obtain the composite powder D, wherein during the preparation of the composite powder D by mechanical ball milling, the mass ratio of a total mass of the powder material to a mass of the milling balls is 1:0-10).

Two gas nozzles are disposed on a lid of the milling can for vacuumizing and filling with an inert gas after sealing. The protective gas is the inert gas, such as helium, argon, or a mixed gas of argon and helium, with a purity of 99.99 wt. %, wherein the oxygen content is less than 0.0001 wt. %. Wherein the ball milling machine is a vertical planetary ball milling machine or an omni-directional planetary ball milling machine, and revolution and rotation directions are changed every 25-35 min during ball milling.

According to the method for preparing a nano spherical oxide dispersion strengthening phase in the present disclosure, the composite powder D is subjected to hot forming to prepare a nano oxide dispersion strengthened alloy, and then the prepared nano oxide dispersion strengthened alloy is subjected to hot rolling and annealing heat treatment, to obtain a nano spherical oxide dispersion strengthened alloy.

The hot forming is one selected from the group consisting of powder extrusion, powder forging, and hot isostatic pressing.

The hot rolling temperature is a common rolling temperature of the matrix alloy, a total deformation is greater than 40%. The hot rolling temperature of the Fe—Cr—W—Ti or Fe—Cr—NV alloy as the matrix alloy is 950-1050° C.

The annealing heat treatment is vacuum annealing heat treatment; the annealing temperature is greater than $T_x$° C., and the annealing time is 1-3 h; and the T is the crystallization temperature of the amorphous oxide A.

According to the method for preparing a nano spherical oxide dispersion strengthening phase in the present disclosure, the inert gas is helium, argon, or a mixed gas of argon and helium, with a purity of 99.99 wt. %, wherein oxygen content is less than 0.0001 wt. %.

According to the method for preparing a nano spherical oxide dispersion strengthening phase in the present disclosure, the tensile strength of the nano spherical oxide dispersion strengthened Fe-14Cr-3W-0.4Ti-based alloy prepared by using the method is greater than 1620 MPa at room temperature and greater than 610 MPa at 700° C., the prepared alloy shows adequate plasticity and elongation significantly greater than that of similar products, and its comprehensive mechanical properties are obviously superior to those of the same brand and same type alloys.

According to the method for preparing a nano spherical oxide dispersion strengthening phase in the present disclosure, when the prepared product is a Fe-14Cr-3W-0.4Ti-1.0$Y_2O_3$ alloy, its elongation is greater than 12.50%.

According to the method for preparing a nano spherical oxide dispersion strengthening phase in the present disclosure, when the prepared product is a Fe-14Cr-3W-0.4Ti-1.5$Y_2O_3$ alloy, its elongation is greater than 12.00%.

According to the method for preparing a nano spherical oxide dispersion strengthening phase in the present disclosure, when the prepared product is a Fe-14Cr-3W-0.41Ti-2.0$Y_2O_3$ alloy, its elongation is greater than 11.50%.

According to the method for preparing a nano spherical oxide dispersion strengthening phase in the present disclosure, the mechanical ball milling in stages is used to prepare the powder with a dispersed nano oxide strengthening phase. Wherein, in the process of preparing the composite powder C by ball milling in the first stage, by controlling the mass ratio of the oxide A to the first part of the pre-alloy powder B and the ball milling parameters, an appropriate amount of the first part of the pre-alloy powder B with plasticity can be coordinated the deformation and crush of oxide powder A during ball milling, and effectively promote the uniformly dispersion of the oxide A in the pre-alloy powder B, and significantly improve the nano-sizing effect.

According to the method for preparing a nano spherical oxide dispersion strengthening phase in the present disclosure, the mechanical ball milling in stages is used to prepare the powder with a dispersed nano oxide strengthening phase. Wherein, in the process of preparing the composite powder C by ball milling in the first stage, by controlling the mass ratio of the oxide A to the first part of the original alloy powder B and the ball milling parameters, the crystal structure of the oxide A can be effectively controlled, and the oxide A with a high mass ratio can more effectively undergo structural transformation during high-energy ball milling, that is, can be transformed from a crystal structure into an amorphous structure, and the oxide A in the prepared composite powder C has a completely amorphous structure, which provides a structural basis for the subsequent preparation of the composite powder D.

According to the method for preparing a nano spherical oxide dispersion strengthening phase in the present disclosure, in the second stage in the method of mechanical ball milling in stages, in the process of preparing the composite powder D by ball milling and mixing, the composite powder C containing the high mass ratio oxide A is used as a raw material without adding the oxide A again. This stage can further efficiently disperse the oxide A in the composite powder C, which is beneficial to the formation of an effective nano-scale metal oxide strengthening phase in the subsequent hot forming of the composite powder D.

According to the method for preparing a nano spherical oxide dispersion strengthening phase in the present disclosure, the composite powder C prepared by the method is used as a basic powder of the oxide strengthened powder, and can be used to prepare a metal powder strengthened by various nano oxides. The method may be extended to prepare the same type nano oxide strengthening phase.

In the present disclosure, through coordinately controlling the mechanical ball mil ling parameters and the mass compatibility of the milling balls with different diameters, while the oxide powder is crushed efficiently, the high-energy effect of the ball milling system causes the oxide to undergo amorphous structure transformation to obtain a nano amorphous structure oxide that is uniformly distributed in the pre-alloyed powder. The amorphous structure provides diffusion channels for Ti, W, and Cr atoms in the alloy powder. In the subsequent hot forming process, Ti, W, and Cr atoms diffuse and bind with the amorphous oxide, to form a new nano-scale nearly spherical and/or spherical Y—Ti—O phase, Y—Cr—O phase, and Y—W—O phase, which are dispersed in the iron-based alloy matrix. The nano-scale strengthening phase dispersed in the grains hinders the dislocation movement, and the strengthening phase distributed at the grain boundaries hinders the grain boundary movement, thus improving the strength, plasticity, and toughness of the product.

Beneficial Effects of the Invention

Beneficial Effects

The present disclosure, a method for preparing a nano spherical oxide dispersion strengthening phase, proposes using a micron oxide to prepare a nano spherical oxide strengthening phase for the first time. First, a completely amorphous structure nano oxide/matrix alloy composite powder is prepared by using mechanical ball milling in stages. In the first stage, the micron oxide and an appropriate amount of the matrix alloy powder are mixed and ball milled to efficiently obtain a composite powder with a completely amorphous structure nano oxide uniformly distributed in the matrix alloy powder; in the second stage, the composite powder obtained in the first stage and the remaining matrix alloy powder are uniformly mixed by ball milling; and then the uniformly mixed powder is sequentially subjected to hot forming, hot rolling, and heat treatment, to obtain a nano spherical oxide dispersion strengthened alloy, (1) The present disclosure, a method for preparing a nano spherical oxide dispersion strengthening phase, proposes using a micron oxide to prepare a nano spherical oxide strengthening phase for the first time. The strengthening phase is uniformly distributed inside grains and at grain boundaries, achieving alloy strengthening.

(2) The present disclosure, a method for preparing a nano spherical oxide dispersion strengthening phase, the oxide in the composite powder obtained by ball milling in the first stage is completely amorphized and has a fully amorphous structure by mechanical ball milling in stages, to provide structural and thermodynamic conditions for the preparation of the composite powder by ball milling and mixing in the second stage and for ensuring the formation of the nano spherical oxide strengthening phase.

(3) According to the method for preparing a nano spherical oxide dispersion strengthening phase in the present disclosure, the method of mechanical ball milling in stages is used. In the first stage of ball milling, the oxide powder and a part of the matrix alloy powder are first ball milled to ensure that the oxide powder is completely nano-sized, to obtain a composite powder with a fully amorphous structure nano oxide uniformly distributed in the matrix alloy powder, thereby greatly improving the efficiency of ball milling.

(4) According to the method for preparing a nano spherical oxide dispersion strengthening phase in the present disclosure, in the second stage, the composite powder obtained in the first stage and the remaining matrix alloy powder are mixed by ball milling to obtain a composite powder with a uniformly distributed nano oxide, and the particle size of the matrix alloy powder has at least two scale distributions; and a product with uniformly distribution of the nano spherical oxide and bimodal distribution of the matrix grain size is obtained through powder forming and subsequent processing.

(5) According to the method for preparing a nano spherical oxide dispersion strengthening phase in the present disclosure, in the first stage, the micron oxide and a part of the matrix alloy powder may also be added in batches for mixing and ball milling, to obtain a composite powder with a multi-scale nano oxide uniformly distributed in the matrix alloy powder; in the second stage, the remaining matrix alloy powder is added in batches for ball milling and mixing, and the particle size of the obtained composite powder has multi-scale distribution; and an alloy with uniform distribution of the multi-scale nano spherical oxide and multi-scale distribution of the matrix grain size can be obtained through powder forming and subsequent processing.

(6) According to the method for preparing a nano spherical oxide dispersion strengthening phase in the present disclosure, through process design, a multi-scale (a few nanometers to a hundred nanometers) and multi-phase ($Y_2O_3$, TiO, $Y_2TiO_5$, $Y_2TiO_7$, Y—Ti—O, Y—Cr—O, and Y—W—O) dispersion strengthened alloy is obtained by optimizing. Due to the synergistic effect of multi-size and multi-type nano spherical strengthening phases, the alloy has excellent mechanical properties at room temperature to high temperature, and especially the plasticity and toughness of the alloy product are significantly improved.

(7) According to the method for preparing a nano spherical oxide dispersion strengthening phase in the present disclosure, the spherical oxide strengthening phase is obtained through heat treatment, and the prepared alloy microstructure can be controlled. The obtained nano spherical oxide has the following advantages: 1) Compared with other strengthening phases with irregular morphology, the obtained nano spherical oxide can significantly enhance the dispersion strengthening effect of the strengthening phase and increase the strength of the alloy. 2) Compared with other oxides with irregular morphology, the uniformly distribution of the nano spherical oxide can effectively improve the plasticity of the alloy. 3) The nano spherical oxide formed in the process of powder hot forming and subsequent processing is not only stable and regular in shape and low in surface energy due to the smallest surface area of spherical particles, but also has further enhanced stability and compatibility with the surrounding matrix due to the formation in the process of alloy forming and subsequent processing. These can further enhance the high-temperature stability of the strengthening phase and inhibit the growth of the strengthening phase under high-temperature conditions. 4) The nano spherical oxide distributed at the grain boundaries helps to inhibit the migration of the grain boundaries and the growth of the grains. 5) The anisotropy of the oxide strengthening phase can be effectively reduced, and the comprehensive performance of the alloy can be improved.

In summary, the present disclosure provides a method for preparing a nano spherical oxide dispersion strengthening phase, and proposes the design idea of using a micron oxide to prepare a nano spherical oxide dispersion strengthened alloy, and a nano spherical oxide dispersion strengthened alloy with excellent comprehensive mechanical properties is prepared through the coordination of a plurality of preparation process parameters. Especially under the premise of ensuring the tensile strength of the product, the present disclosure can also greatly increase the elongation of the product.

BRIEF DESCRIPTION OF THE DRAWINGS

FIG. 1 shows that the nano spherical oxide is uniformly distributed.

FIG. 2 to FIG. 4 show that the nano oxide strengthening phase is spherical. FIG. 2 shows a multi-scale distribution of the nano oxide strengthening phase in the alloy.

FIG. 5 shows the fine grain and uniformly distributed nano spherical oxide in the alloy.

FIG. 6 shows that the oxide strengthening phase is irregular.

DETAILED DESCRIPTION OF THE EMBODIMENTS

Example 1

Fe-14Cr-3W-0.4Ti-1.5$Y_2O_3$ (wt. %) alloy

Figure 1:
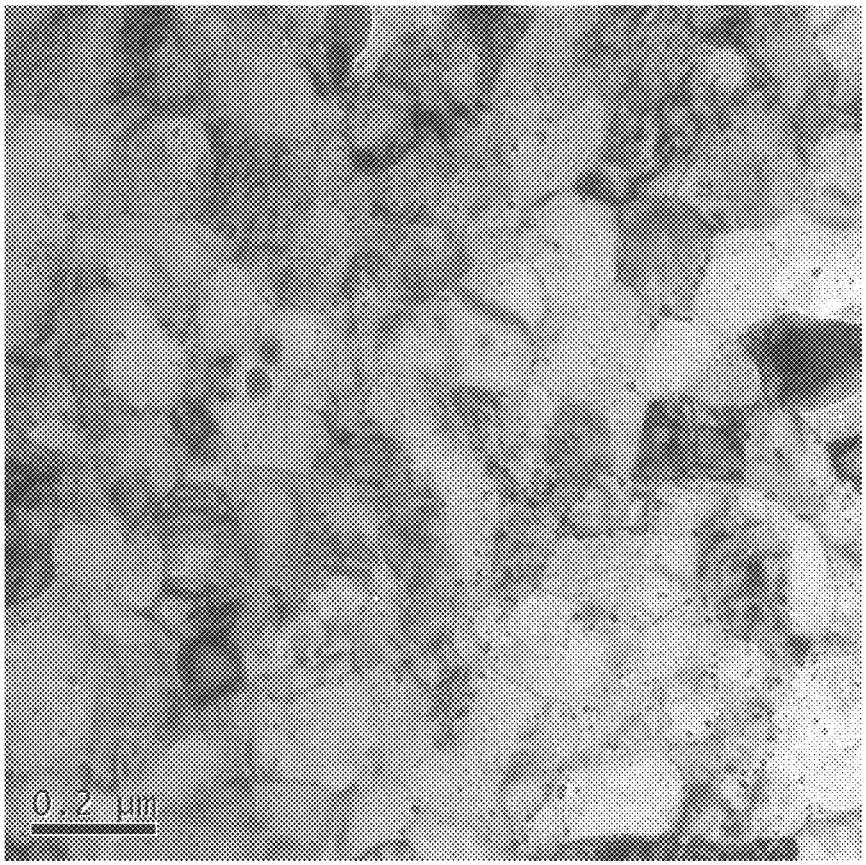
FIG. 1 presents a TEM image showing the microstructure of an alloy prepared in Example 1.
Figure 2:
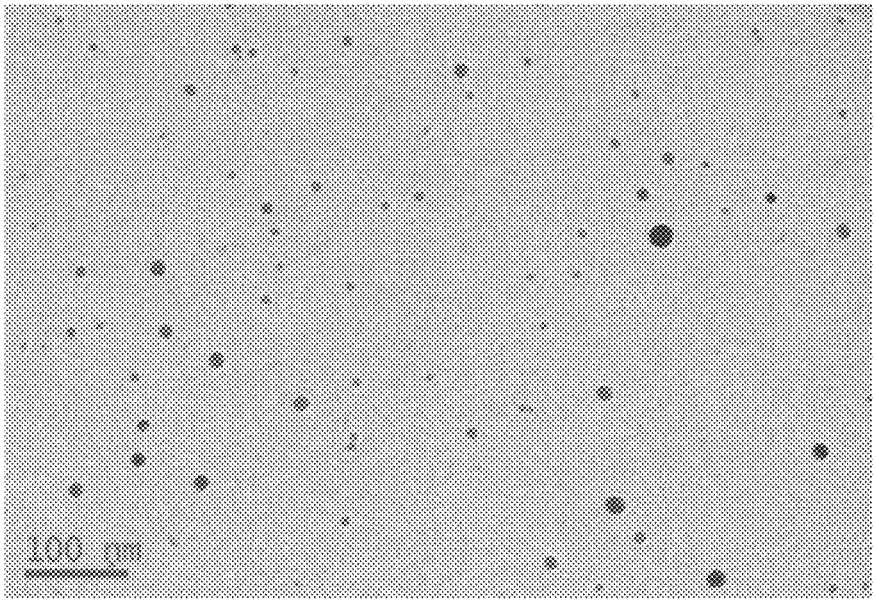
FIG. 2 to FIG. 4 present TEM images showing a nano oxide strengthening phase extracted from an alloy prepared in Example 1.
Figure 3:
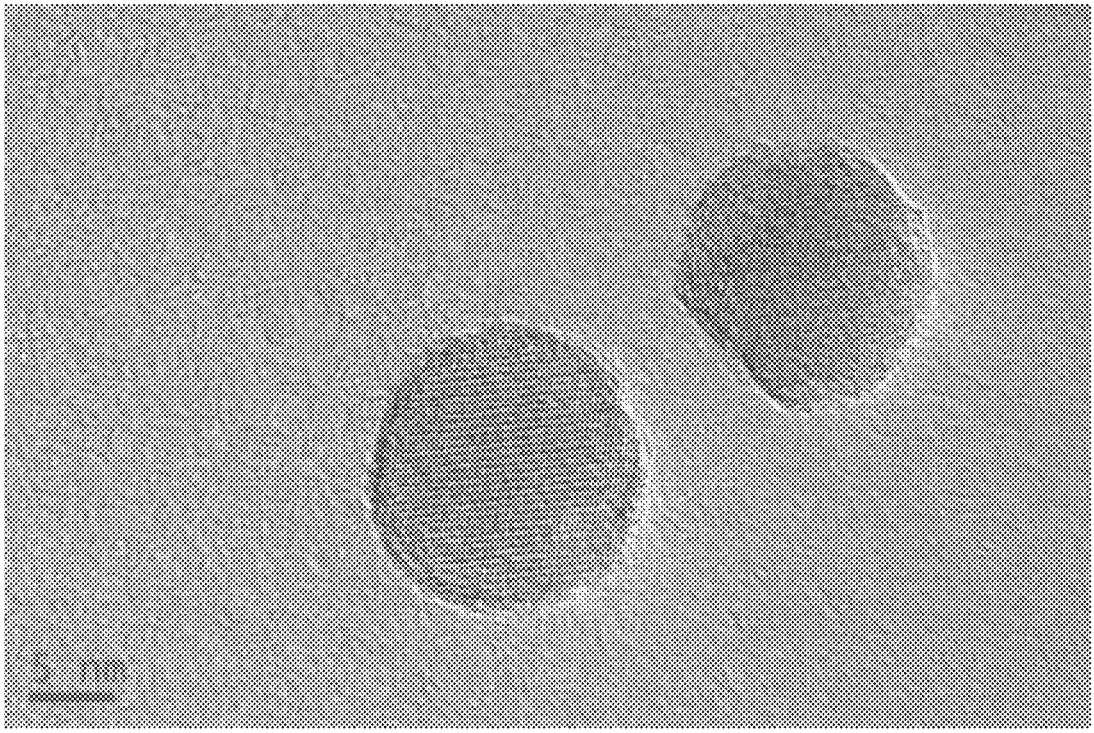
Figure 4:
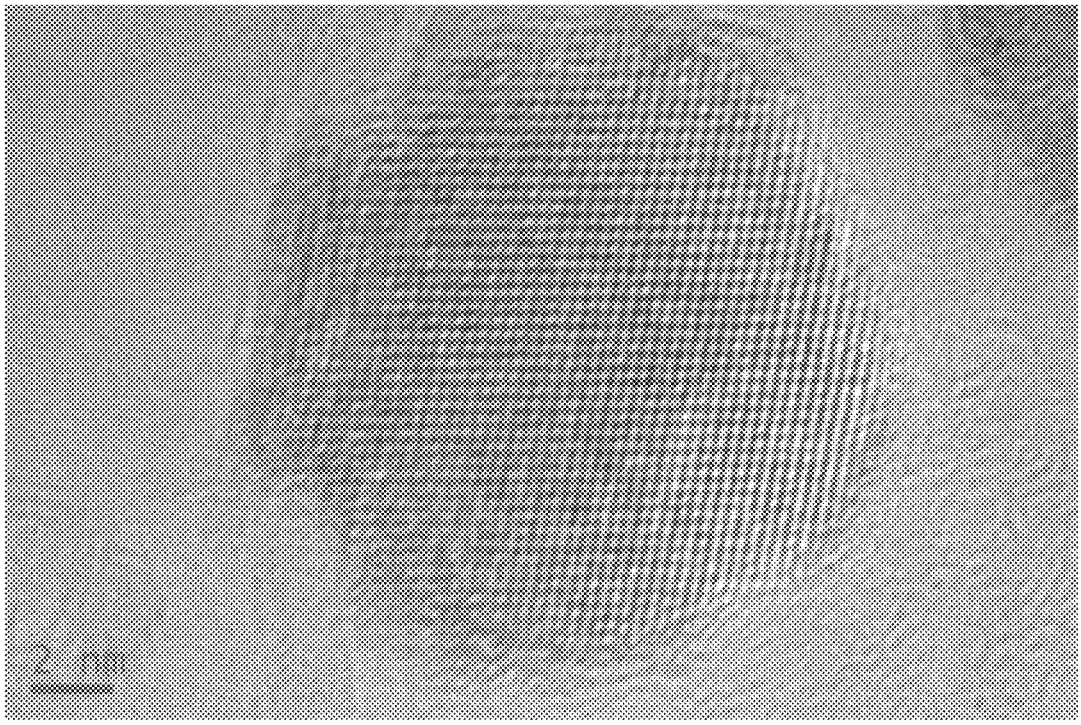

A preparation process is as follows:

Step 1: A total of 300 g of 60 g of a $Y_2O_3$ powder and 240 g of a gas-atomized Fe-14Cr-3W-0.4Ti (wt. %) pre-alloyed iron-based powder was weighed according to a mass ratio of 1:4, and filled into a milling can. Wherein the particle size of the pre-alloyed iron-based powder was less than or equal to 150 μm, and the particle size of the $Y_2O_3$ powder was less than or equal to 10 μm. According to the ball-to-powder mass ratio of 10:1, 3000 g of milling balls with diameters of 20 mm, 15 mm, 10 mm, 8 mm, 5 mm, and 3 mm respectively according to a mass ratio of 1:1:1:1:1:1 was weighed and filled into the milling can.

Step 2: The milling can was sealed, and vacuumized to a vacuum level less than or equal to 0.1 Pa, and then filled with high-pure argon.

Step 3: The milling can was installed into a vertical planetary ball milling machine to perform mechanical ball milling. Wherein the mechanical ball milling parameters were set as follows: a rotating speed of 300 r/min, and a mechanical ball milling time of 60 h. The revolution and rotation directions were changed once per 30 mm during ball milling.

Step 4: After the mechanical ball milling is completed, the powder was sieved under an inert gas atmosphere in a glovebox to obtain the ODS powder E.

Step 5: A total of 1850 g of 150 g of the ODS powder E and the pre-alloyed iron-based powder was filled into the milling can, milling balls were supplemented according to the specification of the milling balls in step 1 to ensure that the ball-to-powder mass ratio is 10:1, and the milling can was sealed and vacuumized, and then was installed into the vertical planetary ball milling machine to perform mechanical ball milling. The mechanical ball milling parameters were set as follows: a rotating speed of 300 r/min, and a mechanical ball milling time of 40 h. The final ODS composite powder is obtained.

Step 6: The foregoing composite powder was filled into a pure-iron can, and hot extrusion was carried out at an extrusion temperature of 850° C., an extrusion speed of 15 mm/s, and an extrusion ratio of 10:1. Then the as-extruded alloy was hot rolled at a temperature of 850° C., a rolling speed of 0.36 m/s, and a total deformation of 80%. Final, the hot-rolled alloy was heat treated at a temperature of 950° C. for 1 h, and air cooled, to obtain the nano spherical oxide dispersion strengthened iron-based alloy.

FIG. 1 to FIG. 4 show that the ODS iron-based alloy obtained in this example has a multi-scale spherical strengthening phase with a size of 2 nm to 100 nm, multi-scale fine grains, its tensile strength reaches 1578 MPa at room temperature and 622 MPa at 700° C., and its elongation is 12.85% at room temperature.

Example 2

Fe-14Cr-3W-0.4Ti-1.0$Y_2O_3$ (wt. %) Alloy

A preparation process is as follows:

Step 1: A total of 300 g of 75 g of a $Y_2O_3$ powder and 225 g of a gas-atomized Fe-14Cr-3W-0.4Ti (wt. %) pre-alloyed iron-based powder was weighed according to a mass ratio of 1:3, and filled into a milling can. Wherein the particle size of the pre-alloyed iron-based powder was less than or equal to 150 μm, and the particle size of the $Y_2O_3$ powder was less than or equal to 10 μm. According to the ball-to-powder ratio of 12:1, 3600 g of milling balls with diameters of 20 mm, 15 mm, 10 mm, 8 mm, 5 mm, and 3 mm respectively according to a mass ratio of 1:1:1:1:1:1 was weighed and filled into the milling can.

Step 2: The milling can was sealed and vacuumized to a vacuum level less than or equal to 0.1 Pa, and then filled with high-pure argon.

Step 3: The milling can was installed into a vertical planetary ball milling machine to perform mechanical ball milling. Wherein the mechanical ball milling parameters were set as follows: a rotating speed of 280 r/min, and a mechanical ball milling time of 120 h. The revolution and rotation directions were changed once per 30 min during ball milling.

Step 4: After the mechanical ball milling is completed, the powder was sieved under an inert gas atmosphere in a glovebox to obtain the ODS powder F.

Step 5: A total of 3750 g of 150 g of the ODS powder F and 3600 g of the remaining pre-alloyed iron-based powder was mixedly filled into the milling can, milling balls were supplemented according to the specification of the milling balls in step 1 to ensure that the ball-to-powder mass ratio is 10:1, the milling can was sealed and vacuumized, and then was installed into the vertical planetary ball milling machine to perform mechanical ball milling. Wherein the mechanical ball milling parameters were set as follows: a rotating speed of 280 r/min, and a mechanical ball milling time of 30 h. The final ODS composite powder is obtained.

Step 6: The foregoing composite powder was filled into a pure-iron can, and hot extrusion was carried out at an extrusion temperature of 950° C., an extrusion speed of 25 min/s, and an extrusion ratio of 11:1. Then the as-extruded alloy was hot rolled at a temperature of 950° C., a rolling speed of 0.36 m/s, and a total deformation of 60%. Final, the hot-rolled alloy was heat treated at a temperature of 1050° C. for 1 h, and air cooled, to obtain the nano spherical oxide dispersion strengthened iron-based alloy.

Figure 5:
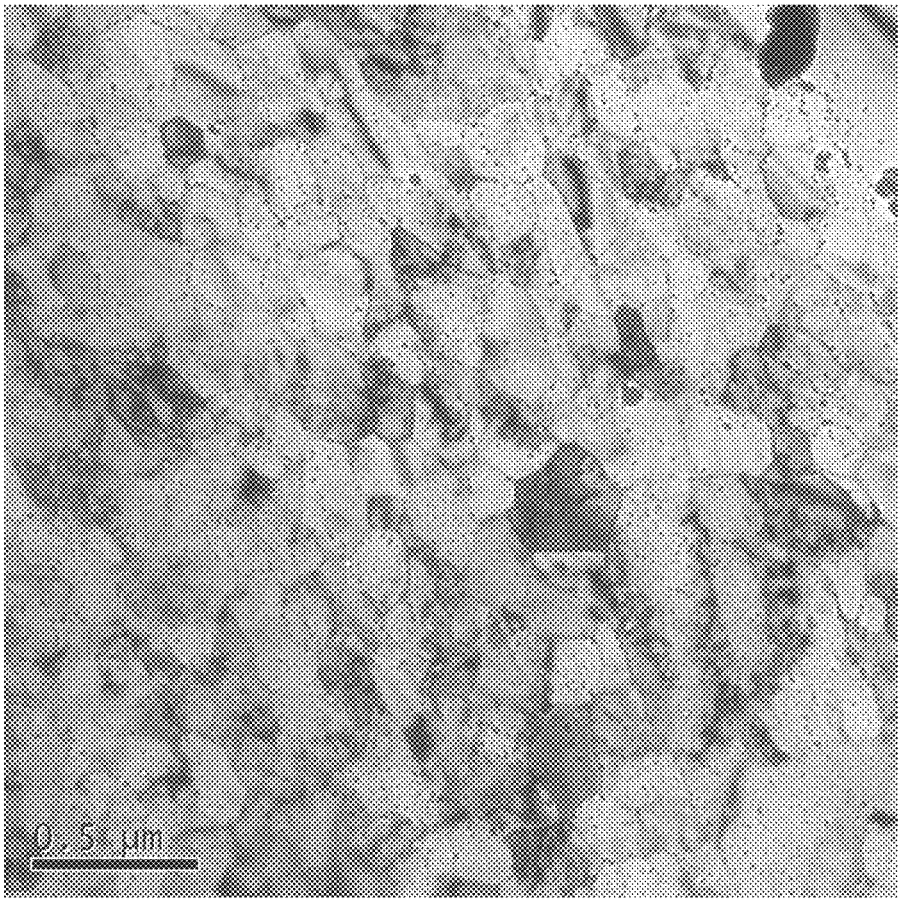
FIG. 5 presents a TEM image showing the microstructure of an alloy prepared in Example 2.

FIG. 5 shows that the ODS iron-based alloy obtained in this example has a multi-scale spherical strengthening phase with a size of 2 nm to 100 nm, and multi-scale fine grains, the oxide is completely transformed into amorphous solid, thereby achieving completely amorphization. The tensile strength of the ODS iron-based alloy reaches 1621 MPa at room temperature and 613 MPa at 700° C., the elongation is 12.13% at room temperature.

Example 3

Fe-14Cr-3W-0.4Ti-2.0$Y_2O_3$ (wt. %) alloy

A preparation process is as follows:

Step 1: A total of 600 g of 100 g of a $Y_2O_3$ powder and 500 g of a gas-atomized Fe-14Cr-3W-0.4Ti (wt. %) pre-alloyed iron-based powder was weighed according to a mass ratio of 1:5, and filled into a milling can. Wherein the particle size of the pre-alloyed iron-based powder was less than or equal to 150 μm, and the particle size of the $Y_2O_3$ powder was less than or equal to 10 μm. According to the ball-to-powder ratio of 15:1, 9000 g of milling balls with diameters of 20 mm, 15 mm, 10 mm, 8 mm, 5 mm, and 3 mm respectively according to a mass ratio of 1:1:1:1:1:1 was weighed and filled into the milling can.

Step 2: The milling can was sealed and vacuumized to a vacuum level less than or equal to 0.1 Pa, and then filled with high-pure argon.

Step 3: The milling can was installed into a vertical planetary ball milling machine to perform mechanical ball milling. Wherein the mechanical ball milling parameters were set as follows: a rotating speed of 260 r/min, and a mechanical ball milling time of 80 h. The revolution and rotation directions were changed once per 30 min during ball milling.

Step 4: After the mechanical ball milling is completed, the powder was sieved under an inert gas atmosphere in a glovebox to obtain the ODS powder G.

Step 5: A total of 2500 g of 300 g of the ODS powder & and 2200 g of the pre-alloyed iron-based powder was mixedly filled into the milling can, milling balls were supplemented according to the specification of the milling balls in step 1 to ensure that the ball-to-powder mass ratio is 10:1, the milling can was sealed and vacuumized, and then was installed into the vertical planetary ball milling machine to perform mechanical ball milling. Wherein the mechanical ball milling parameters were set as follows: a rotating speed of 260 r/min, and a mechanical ball milling time of 20 h. The ODS composite powder H is obtained.

Step 6: A total of 1250 g of 150 g of the ODS composite powder H and 1100 g of the pre-alloyed iron-based powder was filled into the milling can, and the foregoing operations were repeated for mechanical ball milling with unchanged parameters, to obtain the final ODS composite powder.

Step 7: The foregoing composite powder was filled into a pure-iron can, and hot extrusion was conducted at an extrusion temperature of 950° C., an extrusion speed of 15 mm/s, and an extrusion ratio of 12:1. Then the as-extruded alloy was hot rolled at a temperature of 950° C., a rolling speed of 0.36 m/s, and a total deformation of 80%. Final the hot-rolled alloy was heat treated at a temperature of 1050° C. for 1 h, and air cooled, to obtain the nano spherical oxide dispersion strengthened iron-based alloy.

The ODS iron-based alloy obtained in this example has a multi-scale spherical strengthening phase uniformly dispersed in the matrix and with a size of 2 nm to 500 nm, and its grain is multi-scale fine grain, the tensile strength reaches 1688 MPa at room temperature and 632 MPa at 700° C., and the elongation is 12.05% at room temperature.

Comparative Example 1

Fe-14Cr-3W-0.4Ti-1.5$Y_2O_3$ (wt. %) Alloy

A preparation process is as follows:

Step 1: A total of 300 g of a $Y_2O_3$ powder and a gas-atomized Fe-14Cr-3W-0.4Ti (wt. %) pre-alloyed iron-based powder was weighed according to a mass ratio of 1.5:98.5, and filled into a milling can. Wherein the particle size of the pre-alloyed iron-based powder was less than or equal to 150 and the particle size of the $Y_2O_3$ powder was less than 10 μm. According to the ball-to-powder ratio of 10:1, 3000 g of milling balls with diameters of 20 mm, 15 mm, 10 mm, 8 mm, 5 mm, and 3 mm respectively according to a mass ratio of 1:1:1:1:1:1 was weighed and filled into the milling can.

Step 2: The milling can was sealed and vacuumized to a vacuum level less than or equal to 0.1 Pa, and then filled with high-pure argon.

Step 3: The milling can was installed into a vertical planetary ball milling machine to perform mechanical ball milling. Wherein the mechanical ball milling parameters were set as follows: a rotating speed of 300 r/min, and a mechanical ball milling time of 60 h. The revolution and rotation directions were changed once per 30 min during ball milling.

Step 4: After the mechanical ball milling is completed, the powder was sieved under an inert gas atmosphere in a glovebox to obtain the ODS powder I.

Step 5: The foregoing composite powder was filled into a pure-iron can, and hot extrusion was carried out at an extrusion temperature of 850° C., an extrusion speed of 15 mm/s, and an extrusion ratio of 10:1. Then the as-extruded alloy was hot rolled at a temperature of 850° C., a rolling speed of 0.36 m/s, and a total deformation of 80%. Final, the hot-rolled alloy was heat treated at a temperature of 950° C. for 1 h, and air cooled, to obtain the nano oxide dispersion strengthened iron-based alloy.

In the ODS iron-based alloy obtained in this comparative example, the final oxide morphology is irregular. The size of the strengthening phase in the obtained ODS iron-based alloy is greater than 0.5 μm, and the tensile strength of the obtained ODS iron-based alloy can reach 1255 MPa at room temperature and 408 MPa at 700° C., and the elongation is 7.23% at room temperature.

Comparative Example 2

Fe-14Cr-3W-0.4Ti-1.0$Y_2O_3$ (wt. %) Alloy

A preparation process is as follows:

Step 1: 75 g of a Y powder was weighed and filled into a milling can. The particle size of the $Y_2O_3$ powder was less than 10 μm. According to the ball-to-powder ratio of 10:1, 750 g of milling balls with diameters of 20 mm, 15 mm, 10 mm, 8 mm, 5 mm, and 3 mm respectively according to a mass ratio of 1:1:1:1:1:1 was weighed and filled into the milling can.

Step 2: The milling can was sealed and vacuumized to a vacuum level less than or equal to 0.1 Pa, and then filled with high-pure argon.

Step 3: The milling can was installed into a vertical planetary ball milling machine to perform mechanical ball milling. The mechanical ball milling parameters were set as follows: a rotating speed of 300 r/min, and a mechanical ball milling time of 60 h. The revolution and rotation directions were changed once per 30 min during ball milling, Step 4: After the mechanical ball milling is completed, the powder was sieved under an inert gas atmosphere in a glovebox to obtain the oxide powder J.

Step 5: A total of 4000 g of 40 g of the oxide powder J obtained in step 4 and 3960 g of the gas-atomized Fe-14Cr-3W-0.4Ti. (wt. %) pre-alloyed iron-based powder was weighed according to a mass ratio of 1:99, and milling balls were supplemented according to the specification of the milling balls in step 1 to ensure that the ball-to-powder mass ratio is 10:1, and filled into the milling can. Wherein the particle size of the pre-alloyed iron-based powder was less than or equal to 150 μm, and the foregoing steps were repeated for mechanical ball milling, to obtain the final ODS composite powder.

Step 6: The foregoing composite powder was filled into a pure-iron can, and hot extrusion was carried out at an extrusion temperature of 1200° C., an extrusion speed of 15 mm/s, and an extrusion ratio of 8:1. Then the as-extruded alloy was hot rolled at a temperature of 950° C., a rolling speed of 0.35 m/s, and a total deformation of 80%. Final, the hot-rolled alloy was heat treated at a temperature of 1050° C. for 1 h, and air cooled, to obtain the nano oxide dispersion strengthened alloy.

In the ODS iron-based alloy obtained in this comparative example, the oxide is not completely amorphized, the final oxide morphology is irregular, the size of the strengthening phase in the obtained ODS iron-based alloy is greater than 0.8 μm, the tensile strength of the obtained ODS iron-based alloy is 1295 MPa at room temperature and 423 MPa at 700° C., and the elongation is 6.30% at room temperature.

Comparative Example 3

Fe-14Cr-3W-0.4Ti-2.0$Y_2O_3$ (wt. %) Alloy

A preparation process is as follows:

Step 1: A total of 300 g of 50 g of a $Y_2O_3$ powder and 250 g of a gas-atomized Fe-14Cr-3W-0.4Ti (wt. %) pre-alloyed iron-based powder was weighed according to a mass ratio of 1:5, and filled into a milling can. Wherein the particle size of the pre-alloyed iron-based powder was less than or equal to 150 μm, and the particle size of the $Y_2O_3$ powder was less than or equal to 10 μm. According to the ball-to-powder mass ratio of 5:1, 1500 g of milling balls with diameters of 20 mm, 15 mm, 10 mm, 8 mm, 5 mm, and 3 mm respectively according to a mass ratio of 1:1:1:1:1:1 was weighed and filled into the milling can.

Step 2: The milling can was sealed and vacuumized to a vacuum level less than or equal to 0.1 Pa, and then filled with high-pure argon.

Step 3: The milling can was installed into a vertical planetary ball milling machine to perform mechanical ball milling. The mechanical ball milling parameters were set as follows: a rotating speed of 180 r/min, and a mechanical ball milling time of 40 h. The revolution and rotation directions were changed once per 30 min during ball milling.

Step 4: After the mechanical ball milling is completed, the powder was sieved under an inert gas atmosphere in a glovebox to obtain the ODS powder K.

Step 5: A total of 1250 g of 150 g of the ODS powder K and 1100 g of the pre-alloyed iron-based powder was mixedly filled into the milling can, milling balls were supplemented according to the specification of the milling balls in step 1 to ensure that the ball-to-powder mass ratio is 5:1, the milling can was sealed and vacuumized, and installed into the vertical planetary ball milling machine to perform mechanical ball milling. Wherein the mechanical ball milling parameters were set as follows: a rotating speed of 160 r/min, and a mechanical ball milling time of 10 h. The final ODS composite powder is obtained.

Step 6: The foregoing composite powder was filled into a pure-iron can, and hot extrusion was conducted at an extrusion temperature of 1200° C., an extrusion speed of 15 mm/s, and an extrusion ratio of 8:1. Then the as-extruded alloy was hot rolled at a temperature of 950° C., a rolling speed of 0.35 m/s, and a total deformation of 80%. Final, the hot-rolled alloy was heat treated at a temperature of 1050° C. for 1 h, and air cooled, to obtain the nano oxide dispersion strengthened alloy.

Figure 6:
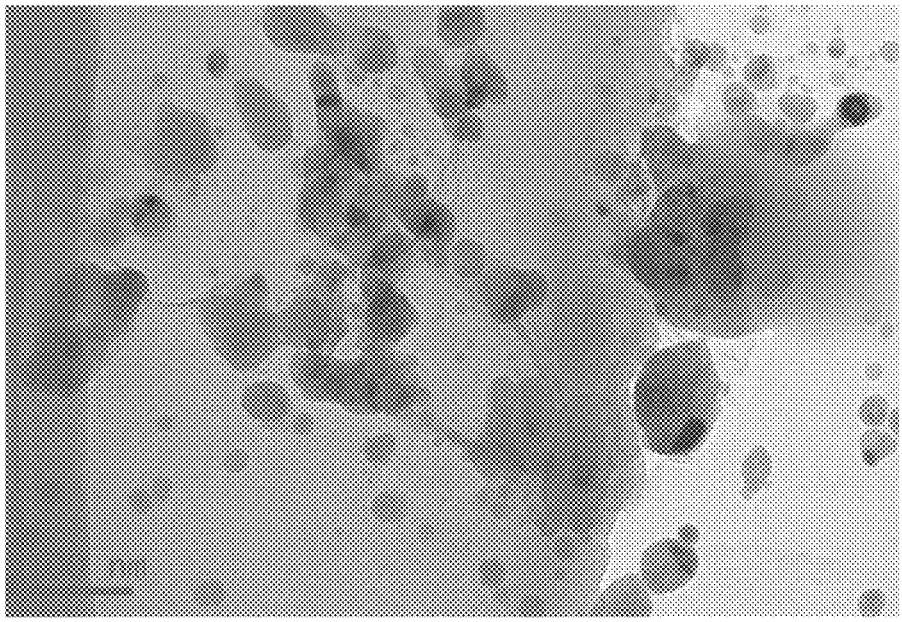
FIG. 6 presents a TEM image showing an oxide strengthening phase extracted from an alloy prepared in Comparative Example 3.

FIG. 6 shows that in the ODS iron-based alloy obtained in this comparative example, the oxide is not amorphized, the final oxide morphology is irregular, the size of the strengthening phase in the obtained ODS iron-based alloy is greater than 1.1 μm, the tensile strength of the obtained ODS iron-based alloy is 978 at room temperature and 333 MPa at 700° C., and the elongation is 5.78% at room temperature.

It can be understood that the foregoing implementations are merely exemplary implementations used to illustrate the principle of the present disclosure, but the present disclosure is not limited thereto. In the art, various modifications and improvements can be made without departing from the idea and essence of the present disclosure, and these modifications and improvements shall fall within the protection scope of the present disclosure.

What is claimed is:

1. A method for preparing a nano spherical oxide dispersion strengthening phase, comprising: mixing a micron oxide with a matrix alloy powder, and preparing a composite powder with a uniformly distributed amorphous nano oxide by a mechanical ball milling in a plurality of stages; in a first stage of the plurality of stages, mixing and ball milling the micron oxide with a part of the matrix alloy powder to prepare the composite powder with a completely amorphous structure nano oxide particles uniformly distributed in the matrix alloy powder; in a second stage of the plurality of stages, uniformly mixing the composite powder obtained in the first stage with a remaining part of the matrix alloy powder by the mechanical ball milling; and subjecting the composite powder obtained in the second stage to a hot forming, a hot rolling, and a heat treatment, to prepare the nano spherical oxide dispersion strengthening phase.

2. The method for preparing the nano spherical oxide dispersion strengthening phase according to claim 1, wherein the nano spherical oxide dispersion strengthening phase comprises at least one selected from the group consisting of $Y_2O_3$, TiO, $Y_2TiO_5$, $Y_2TiO_7$, Y—Ti—O, Y—Cr—O, and Y—W—O; a size of the nano spherical oxide dispersion strengthening phase is less than or equal to 100 nm; and the matrix alloy powder is one selected from the group consisting of a Fe—Cr—W—Ti or Fe—Cr—W alloy, a nickel-based superalloy, a copper alloy, and a high-entropy alloy.

3. The method for preparing the nano spherical oxide dispersion strengthening phase according to claim 2, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

4. The method for preparing the nano spherical oxide dispersion strengthening phase according to claim 1, wherein the hot forming is one selected from the group consisting of a powder extrusion, a powder forging, and a hot isostatic pressing.

5. The method for preparing the nano spherical oxide dispersion strengthening phase according to claim 4, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

6. The method for preparing the nano spherical oxide dispersion strengthening phase according to claim 1, wherein a temperature of the hot rolling is a rolling temperature of a matrix alloy, a total deformation is greater than 40%, and wherein the temperature of the hot rolling with a Fe—Cr—W—Ti or Fe—Cr—W alloy as the matrix alloy is 950-1050° C.

7. The method for preparing the nano spherical oxide dispersion strengthening phase according to claim 6, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

8. The method for preparing the nano spherical oxide dispersion strengthening phase according to claim 1, wherein the heat treatment is a vacuum annealing heat treatment; an annealing temperature is greater than $T_x$° C., and an annealing time is 1-3 h; and the $T_x$ is a crystallization temperature of the amorphous nano oxide.

9. The method for preparing the nano spherical oxide dispersion strengthening phase according to claim 8, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

10. The method for preparing the nano spherical oxide dispersion strengthening phase according to claim 1, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

11. A method for preparing a nano spherical oxide dispersion strengthening phase, comprising:

using an oxide powder as a first raw material and an alloy powder as a second raw material; mixing and ball milling the first raw material with a part of the second raw material to obtain a composite powder with completely amorphous structure nano oxide particles; mixing the composite powder with a remaining part of the second raw material by the mechanical ball milling, to obtain a uniformly mixed composite powder; subjecting the uniformly mixed composite powder to hot forming to prepare a nano-oxide dispersion strengthened alloy; and subjecting the nano-oxide dispersion strengthened alloy to a hot rolling and an annealing heat treatment, to obtain a nano spherical oxide-phase dispersion strengthened alloy, wherein a mass ratio of the first raw material to the part of the second raw material is 1:(1-10), and a mass ratio of the first raw material to the second raw material is (0.5-5):(99.5-95);

the oxide powder of the first raw material is at least one selected from the group consisting of $Y_2O_3$ and $TiO_2$; and the alloy powder of the second raw material is one selected from the group consisting of a Fe—Cr—W—Ti or Fe—Cr—W alloy, a nickel-based superalloy, a copper alloy, and a high-entropy alloy.

12. The method for preparing the nano spherical oxide dispersion strengthening phase according to claim 11, wherein a particle size of the oxide powder of the first raw material is less than 10 μm; and a particle size of the alloy powder of the second raw material is less than or equal to 150 μm.

13. The method for preparing the nano spherical oxide dispersion strengthening phase according to claim 12, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

14. The method for preparing the nano spherical oxide dispersion strengthening phase according to claim 11, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

15. A method for preparing a nano spherical oxide dispersion strengthening phase, comprising the following steps:

step 1: weighing a powder material according to a mass ratio of a first raw material to a second raw material of (0.5-5):(99.5-95); taking milling balls according to a mass ratio of a total mass of the powder material to a mass of the milling balls of 1:(10-20); and filling the first raw material, a part of the second raw material, and the milling balls into a milling can, and then sealing the milling can, wherein the milling balls with diameters of 18-22 mm, 14-16 mm, 9-11 mm, 7-8.5 mm, 4.5-5.5 mm, and 2.5-3.5 mm are compatible according to a mass ratio of (1-2):(1-2):(1-2):(1-2):(1-2):(1-2); and a mass ratio of the first raw material to the part of the second raw material is 1:(1-10);

step 2: vacuumizing the milling can, and then filling the milling can with an inert gas;

step 3: installing the milling can filled with the inert gas in step 2 into a planetary ball milling machine to perform the mechanical ball milling, wherein parameters of the mechanical ball milling comprise a milling time of 60-120 h, and a milling rotating speed of 200-300 r/min;

step 4: after the mechanical ball milling in step 2 is completed, sieving a powder under an inert gas atmosphere in a glovebox to obtain a composite powder with uniformly distributed amorphous nano oxide;

step 5: mixing the composite powder and a remaining part of the second raw material and filling into the milling can, filling the milling balls, and then installing the milling can into the planetary ball milling machine to perform the mechanical ball milling, to obtain the composite powder with the completely amorphous structure nano oxide particles, wherein during a preparation of the composite powder with completely amorphous structure nano oxide particles by the mechanical ball milling, a mass ratio of a total mass of the powder material to a mass of the milling balls is 1:(5-10), and the parameters of the mechanical ball milling comprise a milling time of 20-40 h, and a milling rotating speed of 200-300 r/min; and step 6: subjecting the composite powder with the completely amorphous structure nano oxide particles to hot forming, hot rolling, and heat treatment, to prepare the nano spherical oxide dispersion strengthening phase.

16. The method for preparing the nano spherical oxide dispersion strengthening phase according to claim 15, wherein two gas nozzles are disposed on a lid of the milling can for vacuumizing and filling with an inert gas after sealing;

a protective gas is the inert gas, wherein the inert gas comprises helium, argon, or a mixed gas of the argon and the helium, a purity of the protective gas is 99.99 wt. %, and an oxygen content of the protective gas is less than 0.0001 wt. %; and a ball milling machine is a vertical planetary ball milling machine or an omni-directional planetary ball milling machine, and a revolution direction and a rotation direction are changed every 25-35 min during the mechanical ball milling.

17. The method for preparing the nano spherical oxide dispersion strengthening phase according to claim 16, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

18. The method for preparing the nano spherical oxide dispersion strengthening phase according to claim 15, wherein when the nano spherical oxide dispersion strengthening phase is a Fe-14Cr-3W-0.4Ti-1.0$Y_2O_3$ alloy, an elongation is greater than 12.50%;

when the nano spherical oxide dispersion strengthening phase is a Fe-14Cr-3W-0.4Ti-1.5$Y_2O_3$ alloy, the elongation is greater than 12.00%; and when the nano spherical oxide dispersion strengthening phase is a Fe-14Cr-3W-0.4Ti-2.0$Y_2O_3$ alloy, the elongation is greater than 11.50%.

* * * * *